US007185750B2

(12) United States Patent
Sugata et al.

(10) Patent No.: US 7,185,750 B2
(45) Date of Patent: Mar. 6, 2007

(54) COIN DISTINGUISHING METHOD AND DEVICE

(75) Inventors: Masanori Sugata, Saitama (JP); Tomokuni Takeda, Saitama (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 483 days.

(21) Appl. No.: 10/474,510

(22) PCT Filed: Apr. 24, 2002

(86) PCT No.: PCT/JP02/04057

§ 371 (c)(1),
(2), (4) Date: Oct. 22, 2003

(87) PCT Pub. No.: WO02/089071

PCT Pub. Date: Nov. 7, 2002

(65) Prior Publication Data

US 2004/0124064 A1 Jul. 1, 2004

(30) Foreign Application Priority Data

Apr. 25, 2001 (JP) ..... 2001-127772

(51) Int. Cl.
*G07D 5/00* (2006.01)

(52) U.S. Cl. ..... 194/328; 194/331; 382/136

(58) Field of Classification Search ..... 194/328–333; 382/135, 136, 124, 288, 118; 434/110; 902/7
See application file for complete search history.

(56) References Cited

U.S. PATENT DOCUMENTS 5,236,074 A * 8/1993 Gotaas ..... 194/331
6,484,865 B1 * 11/2002 Hibari et al. ..... 194/330
6,688,449 B1 * 2/2004 Yamagishi ..... 194/328
6,785,412 B2 * 8/2004 Hibari ..... 382/136

FOREIGN PATENT DOCUMENTS

JP 3-290786 12/1991
JP 5-20521 1/1993

(Continued)

*Primary Examiner*—Gene O. Crawford
*Assistant Examiner*—Jeffrey Shapiro
(74) *Attorney, Agent, or Firm*—Armstrong, Kratz, Quintos, Hanson & Brooks, LLP

(57) ABSTRACT

A coin distinguishing method capable of concurrently picking up the images of the surface and the side of a coin by using two light sources, downsizing a device, and providing high-accuracy coin distinguishing. The side of a coin (C) falling through a coin passage (101) in an advancing direction is irradiated with a first light (105) from a flash shooting first light source (104), and the outer periphery portion of the surface of the coin (C) is irradiated with a second light (107) from a flash shooting second light source (106). Then, a fist reflection light (108) reflected off the side of the coin (C) and a second reflection light (109) reflected off the outer periphery portion of the coin (C) are input to an image sensor (110) to concurrently obtain the images of the side and the surface of the coin (C). A mill direction distinguishing unit (113) detects the presence/absence of mills from the picked up images of the coin (C), and a projecting pattern distinguishing unit (114) detects projecting patterns to distinguish the coin (C) based on the detection results.

10 Claims, 5 Drawing Sheets

FOREIGN PATENT DOCUMENTS

| | | |
|---|---|---|
| JP | 7-129808 | 5/1995 |
| JP | 9-167270 | 6/1997 |
| JP | 10-11629 | 1/1998 |
| JP | 10-83471 | 3/1998 |
| JP | 10-222716 | 8/1998 |
| JP | 2000-187747 | 7/2000 |

* cited by examiner

COIN DISTINGUISHING METHOD AND DEVICE

TECHNICAL FIELD

The present invention relates to a coin distinguishing method and device, and more particularly to a coin distinguishing method and device which concurrently obtain the images of a cyclic linear uneven pattern formed on the side of a coin and projecting patterns concentrically imprinted at equal intervals on the outer periphery portion of the surface of the coin and distinguish the coin based on the obtained images.

BACKGROUND ART

Generally, automatic vending machines, money changers and the like using coins are required to distinguish denomination and authenticity of inserted coins.

Conventionally, such a type of coin distinguishing device is configured to have a single or plural magnetic coil sensors disposed at a passage through which a coin inserted through a coin insertion slot passes, to distinguish the material, thickness, size and the like of the coin, and to distinguish the denomination and authenticity of the coin based on the distinguished results.

Besides, it is also proposed to configure so to detect the thickness, size and the like of the coin by an optical sensor such as an image pickup device.

In recent years, however, altered coins, which are foreign currency having a material and a shape similar to those of domestic specie and modified so to have a pattern similar to that of the domestic specie obtained by an optical sensor or a magnetic sensor, are spreading. And, as the altered coins have become having a higher machining accuracy, a problem of difficulty in distinguishing authenticity by a conventional magnetic sensor or optical sensor is occurring. Especially, misuse of foreign currency has become a serious problem because 500-yen coins are coins of large denominations.

Therefore, to distinguish such altered coins, it is necessary to distinguish such coins with a higher accurately, and there have been proposed various methods of using a pattern formed on the surface or side of the coin.

For example, Japanese Patent Application Laid-Open No. 9-167270 discloses a method by which the side of a coin is irradiated with light, reflection light is detected by an optical sensor to obtain an image of the side of the coin, and the presence or not of a cyclic linear uneven pattern (hereinafter called as the mill) formed on the side of the coin is detected based on the obtained image of the side of the coin.

Japanese Patent Application Laid-Open No. 10-83471 discloses a method by which the outer periphery portion of the surface of a coin is irradiated with light, reflection light is detected by an optical sensor to obtain an image of the outer periphery portion of the coin, a projecting pattern (pearl) imprinted concentrically at equal intervals on the outer periphery portion of the coin is detected based on the obtained image of the outer periphery portion of the coin.

Besides, there have been proposed configurations combining various types of methods to distinguish coins with a higher accurately, and Japanese Patent Application Laid-Open No. 10-222716 discloses a method by which both surfaces and side of a coin are irradiated with light, beams of reflection light are collected by mirrors and detected by an optical sensor to obtain the images of the both surfaces and side of the coin at the same time, and the coin is distinguished based on the obtained images of the both surfaces and side of the coin.

But, the prior art disclosed in Japanese Patent Application Laid-Open No. 9-167270 and Japanese Patent Application Laid-Open No. 10-83471 have limitations in improving a distinguishing rate (a rate of distinguishing coins accurately) when a coin is distinguished based on only the images of the surfaces or side of the coin, and the prior art disclosed in Japanese Patent Application Laid-Open No. 10-222716 has disadvantages that two lighting means, two mirrors for collecting beams of reflection light from the both surfaces of the coin to an optical sensor and two deflection plates for preventing the beams of light from the two lighting means from mutually influencing are required to obtain the images of both surfaces of the coin, resulting in a complex structure and having a difficulty in downsizing the device.

DISCLOSURE OF THE INVENTION

Accordingly, the present invention provides a coin distinguishing method and device by which images of mills on the side of a coin and projecting patterns impressed on the outer periphery portion of the surface of the coin can be concurrently taken by a simple structure so that the device can be downsized, and the coin can be distinguished at a high accuracy by distinguishing based on the obtained images.

To achieve the above object, the invention of claim 1 provides a coin distinguishing method, characterized by comprising: irradiating a side of a subject coin with first light; irradiating an outer periphery portion of a surface of the subject coin with second light at a prescribed angle; receiving reflection light of the first light from the side of the subject coin and reflection light of the second light from the outer periphery portion of the surface of the subject coin by an optical sensor to obtain an image including the side and the outer periphery portion of the surface of the subject coin; and distinguishing the subject coin based on the obtained image.

The invention of claim 2 relates to the invention of claim 1, characterized in that the optical sensor is disposed to incline in a direction oblique to the surface of the subject coin so to enable to obtain the image including the side and the outer periphery portion of the surface of the subject coin.

Here, the optical sensor is disposed to incline, for example, approximately 45 degrees to the surface of the subject coin so to enable to obtain the image including the side and the outer periphery portion of the surface of the subject coin.

The invention of claim 3 relates to the invention of claim 2, characterized in that: an image including only the side of the subject coin is cut off from the image including the side and the outer periphery portion of the surface of the subject coin; a shape of the side of the subject coin is detected from the cut-off image including only the side of the subject coin; and the subject coin is distinguished based on the detected shape of the side of the subject coin.

Here, the shape of the side of the coin is called a mill, which is a cyclic linear uneven pattern formed on the side of the coin.

The invention of claim 4 relates to the invention of claim 3, characterized in that: an image including only the outer periphery portion of the surface of the subject coin is cut off from the image including the side and the outer periphery portion of the surface of the subject coin; a projecting pattern impressed on the outer periphery portion of the surface of the subject coin is detected from the cut-off image including only the outer periphery portion of the surface of the subject coin; and the subject coin is distinguished based on the detected projecting pattern of the subject coin.

Here, the projecting pattern is a pattern formed in the form of a circle at equal intervals on the edge of the coin.

The invention of claim 5 relates to the invention of claim 4, characterized in that the second light is irradiated at the prescribed angle capable of obtaining an image suitable for an image processing method which is used for detection of the projecting pattern impressed on the outer periphery portion of the surface of the subject coin.

The invention of claim 6 provides a coin distinguishing device, characterized by comprising: a first light source for irradiating a side of a subject coin with first light; a second light source for irradiating an outer periphery portion of a surface of the subject coin with second light at a prescribed angle; an optical sensor for obtaining an image including the side and the outer periphery portion of the surface of the subject coin by receiving reflection light of the first light from the side of the subject coin and reflection light of the second light from the outer periphery portion of the surface of the subject coin; and distinguishing means for distinguishing the subject coin based on the image obtained by the optical sensor.

The invention of claim 7 relates to the invention of claim 6, characterized in that the optical sensor is disposed to incline in a direction oblique to the surface of the subject coin so as to enable to obtain the image including the side and the outer periphery portion of the surface of the subject coin.

The invention of claim 8 relates to the invention of claim 7, characterized in that the distinguishing means further comprises: side image cut-off means for cutting off an image including only the side of the subject coin from the image including the side and the outer periphery portion of the surface of the subject coin; and side shape detecting means for detecting a shape of the side of the subject coin from the image including only the side of the subject coin cut off by the side image cut-off means; and the subject coin is distinguished based on the shape of the side of the subject coin detected by the side shape detecting means.

The invention of claim 9 relates to the invention of claim 8, characterized in that the distinguishing means further comprises: outer periphery portion image cut-off means for cutting off an image including only the outer periphery portion of the surface of the subject coin from the image including the side and the outer periphery portion of the surface of the subject coin; and projecting pattern detecting means for detecting a projecting pattern impressed on the outer periphery portion of the surface of the subject coin from the image including only the outer periphery portion of the surface of the subject coin taken off by the outer periphery portion image cut-off means, and the subject coin is distinguished based on the projecting pattern of the subject coin detected by the projecting pattern detecting means.

The invention of claim 10 relates to the invention of claim 9, characterized in that the second light source is disposed at a position to irradiate the second light at the prescribed angle capable of obtaining an image suitable for an image processing method used for the projecting pattern detecting means.

Thus, according to the invention, the image of the side of a coin and the image of the outer periphery portion of the surface of the coin can be concurrently taken by a simple structure, so that the device can be made compact, and the presence or not of mills and a projecting pattern impressed on the outer periphery portion are detected from the obtained images. Thus, the coin can be distinguished with a high accuracy.

BEST MODE FOR CARRYING OUT THE INVENTION

An embodiment of the coin distinguishing method and device according to the present invention will be described in detail with reference to the accompanying drawings.

Figure 1:
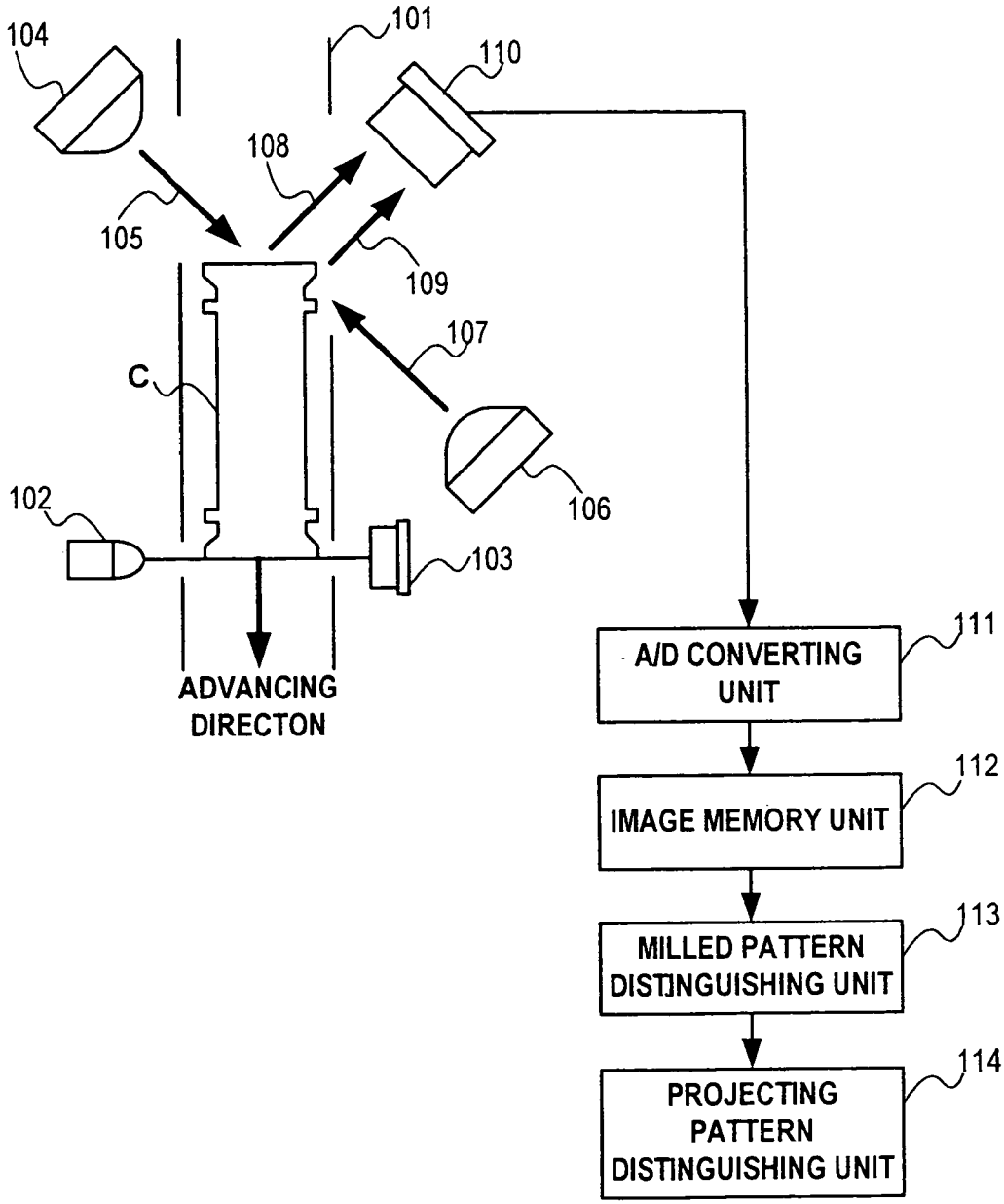
FIG. 1 is a diagram showing a schematic structure of the coin distinguishing device according to the invention.

FIG. 1 is a diagram showing a schematic structure of the coin distinguishing device according to the invention.

As shown in FIG. 1, the coin distinguishing device according to the invention is comprised of a coin passage 101 for falling a subject coin C to be detected (hereinafter called the coin C) in a direction indicated by an arrow in the drawing; a light-emitting device 102 and an outer end detection sensor 103 for detecting the arrival of the end of the coin; a flash shooting first light source 104 for irradiating the side of the coin C with first light 105 in pulse form; a flash shooting second light source 106 for irradiating the surface of the coin C with second light 107 in pulse form; an image sensor 110 for obtaining image signals of the side and surface of the coin C by inputting first reflection light 108 which is reflection of the first light 105 off the side of the coin C and second reflection light 109 which is reflection of the second light 107 off the surface of the coin C; an A/D converting unit 111 for converting the obtained image signal of the surface of the coin C into a digital image signal; an image memory unit 112 for temporarily storing the digitized image signal; a milled pattern distinguishing unit 113 for distinguishing the coin C by detecting the mill pattern on the side of the coin C from the stored image signals and comparing with the features of a previously determined subject denomination to be selected; and a projecting pattern distinguishing unit 114 for distinguishing the coin C by detecting projecting patterns on the outer periphery portion of the coin C from the stored image signals and comparing with the features of the previously determined subject denomination.

Then, a procedure of distinguishing a coin conducted by the coin distinguishing device of the invention will be described.

In the above configuration, the light-emitting device 102 and the outer end detection sensor 103 are disposed to mutually oppose at both sides of the coin passage 101 and at the holes formed in the coin passage 101.

When the coin C is inserted into the coin distinguishing device according to the present invention, the coin C falls freely through the coin passage 101. And, the coin C falling freely through the coin passage 101 blocks light entering from the light-emitting device 102 into the outer end detection sensor 103, and the outer end detection sensor 103 produces a detection output signal, the first light 105 is irradiated in a pulse form from the flash shooting first light source 104 to the side of the coin C based on the detection output signal, and the second light 107 is irradiated in a pulse form from the flash shooting second light source 106 to the outer periphery portion of the surface of the coin C in synchronization with the flash shooting first light source 104.

The image sensor 110 inputs the first reflection light 108 which is reflection of the first light 105 off the side of the coin C and the second reflection light 109 which is reflection of the second light 107 off the outer periphery portion of the surface of the coin C. The image sensor 110 is disposed approximately 45 degrees inclined to the surface of the coin C, so that image signals of the side and outer periphery portion of the coin C can be obtained at the same time. The image sensor 110 is, for example, a CCD sensor or the like.

In this case, an illumination time of the flash shooting first light source 104 and the flash shooting second light source 106 is set to a short time corresponding to a response time of the image sensor 110, so that the image sensor 110 can obtain a still image of the coin C falling freely through the coin passage 101. The image sensor 110 is already through a standby state immediately before the flash shooting.

In the above configuration, the first light 105 and the second light 107 have the same wavelength region but may have different wavelength regions without involving any problem.

And, in this embodiment, the coin C is distinguished based on the image signal corresponding to the still image.

Figure 2:
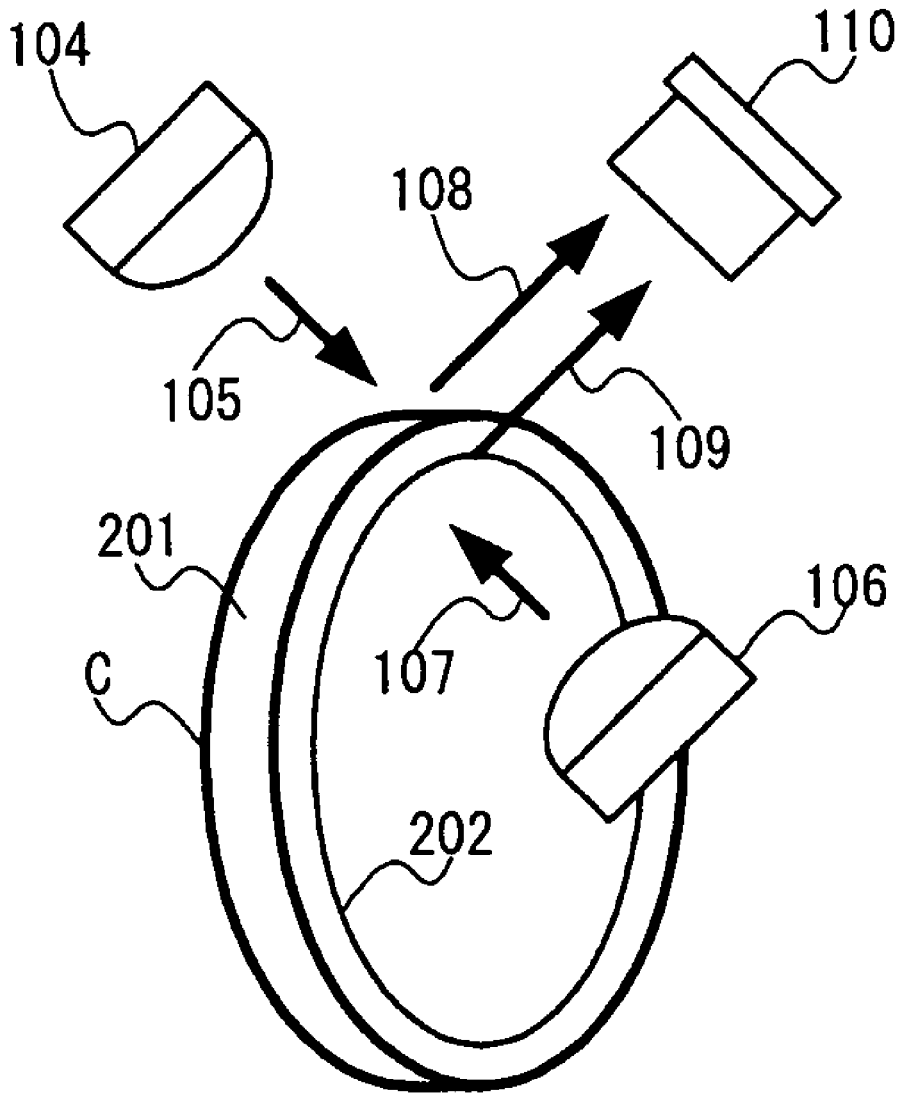
FIG. 2 is a structure diagram stereoscopically showing the lighting state of FIG. 1.

FIG. 2 is a structure diagram stereoscopically showing the lighting state of FIG. 1.

As shown in FIG. 2, a side 201 of the coin C is irradiated with the first light 105 in a pulse form from the flash shooting first light source 104, the image sensor 110 receives the first reflection light 108 which is reflection of the first light 105 from the side 201 of the coin C, a projecting pattern 202 on the surface of the coin C is irradiated with the second light 107 in a pulse form from the flash shooting second light source 106 in synchronization with the flash shooting first light source 104, and the image sensor 110 receives the second reflection light 109 which is reflection of the second light 107 from the projecting pattern 202 on the surface of the coin C to obtain image signals of the side 201 and the projecting pattern 202 of the surface of the coin C at the same time.

Figure 3:
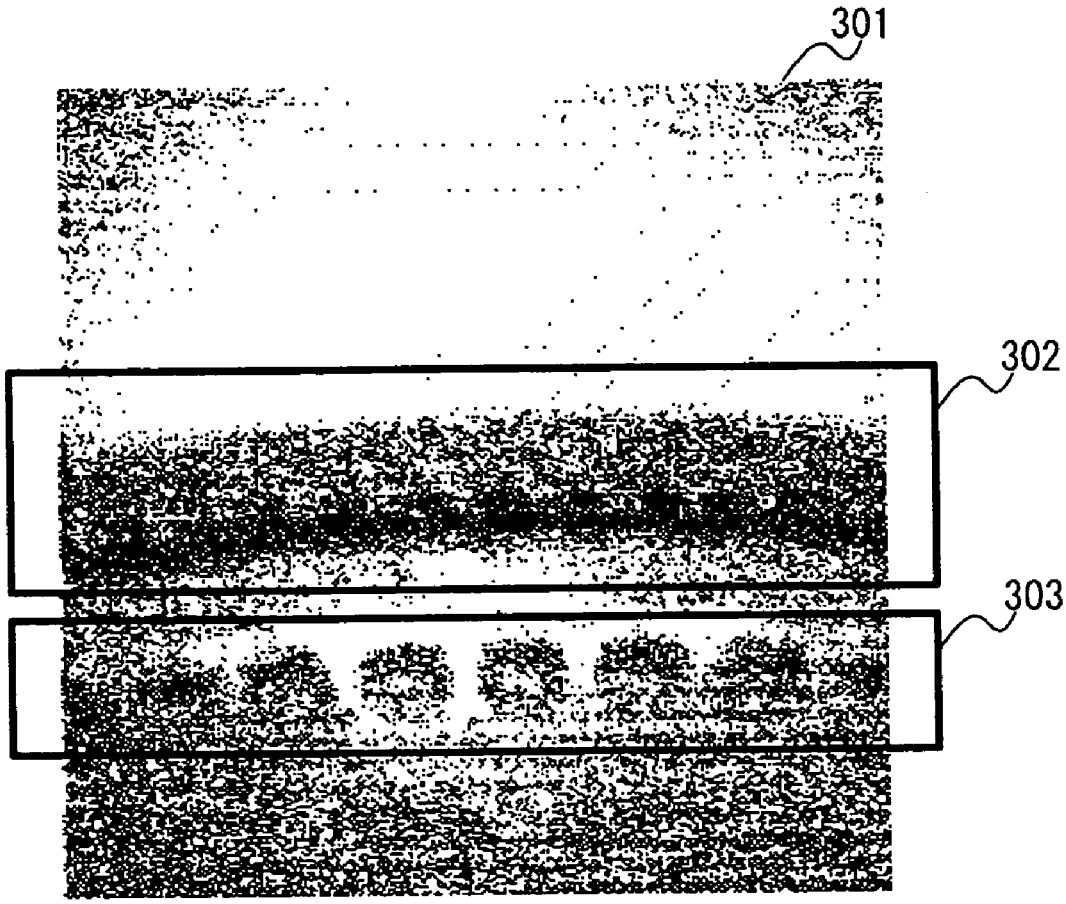
FIG. 3 is a diagram showing an image example of a coin photographed by the structure of FIG. 2.

FIG. 3 shows an example image of the coin which is obtained by the structure of FIG. 2.

An image 301 has the side 201 of the coin C and the projecting pattern 202 on the surface photographed.

Here, the milled pattern distinguishing unit 113 cuts off a coin side image-pickup area 302 from the image 301 and compares with the features of a subject coin to be selected and previously set by detecting the mill pattern on the side 201 of the coin C to distinguish the coin C.

And, the projecting pattern distinguishing unit 114 cuts off a coin outer periphery portion image pickup area 303 from the image 301 and compares with the features of a subject coin to be selected and previously set by detecting the projecting pattern 202 on the surface of the coin C to distinguish the coin C.

The two flash shooting light sources described in the above embodiment can be changed their positions to places suitable for an image processing method for detecting the projecting pattern 202 on the surfaces of the coin C. For example, the projecting pattern 202 on the surface of the coin C shown in FIG. 3 is clearly photographed, but when the detection is made by an image processing method which advisably obtains an image of the projecting pattern 202 with its edge (steps) emphasized than clear photographing, the setting position of the flash shooting second light position is changed.

Figure 4:
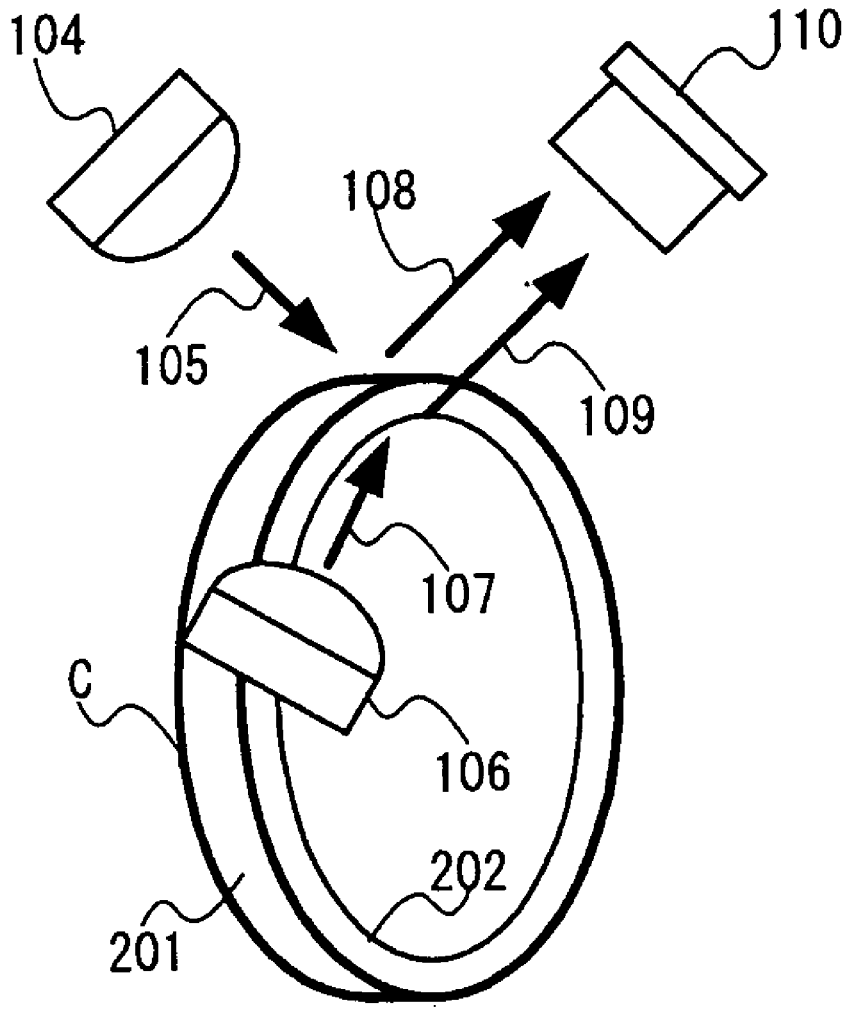
FIG. 4 is a structure diagram stereoscopically showing the lighting state of FIG. 1 with the disposed position of a flash shooting second light source changed in order to photograph with a projecting pattern edge emphasized.

FIG. 4 is a structure diagram stereoscopically showing the lighting state of FIG. 1 with the disposed position of the flash shooting second light source changed to photograph with the edge of the projecting pattern emphasized.

As shown in FIG. 4, the side 201 of the coin C is irradiated with the first light 105 in a pulse form from the flash shooting first light source 104, and the first reflection light 108 which is reflection of the first light 105 off the side 201 of the coin C is received by the image sensor 110.

And, in synchronization with the flash shooting first light source 104, the projecting pattern 202 on the surface of the coin C is irradiated with the second light 107 in a pulse form from the flash shooting second light source 106 at a small angle to the surface of the coin C, and the second reflection light 109 which is reflection of the second light 107 from the projecting pattern 202 on the surface of the coin C is received by the image sensor 110. Thus, image signals of the side 201 of the coin C and the projecting pattern 202 on the surface are obtained at the same time.

Figure 5:
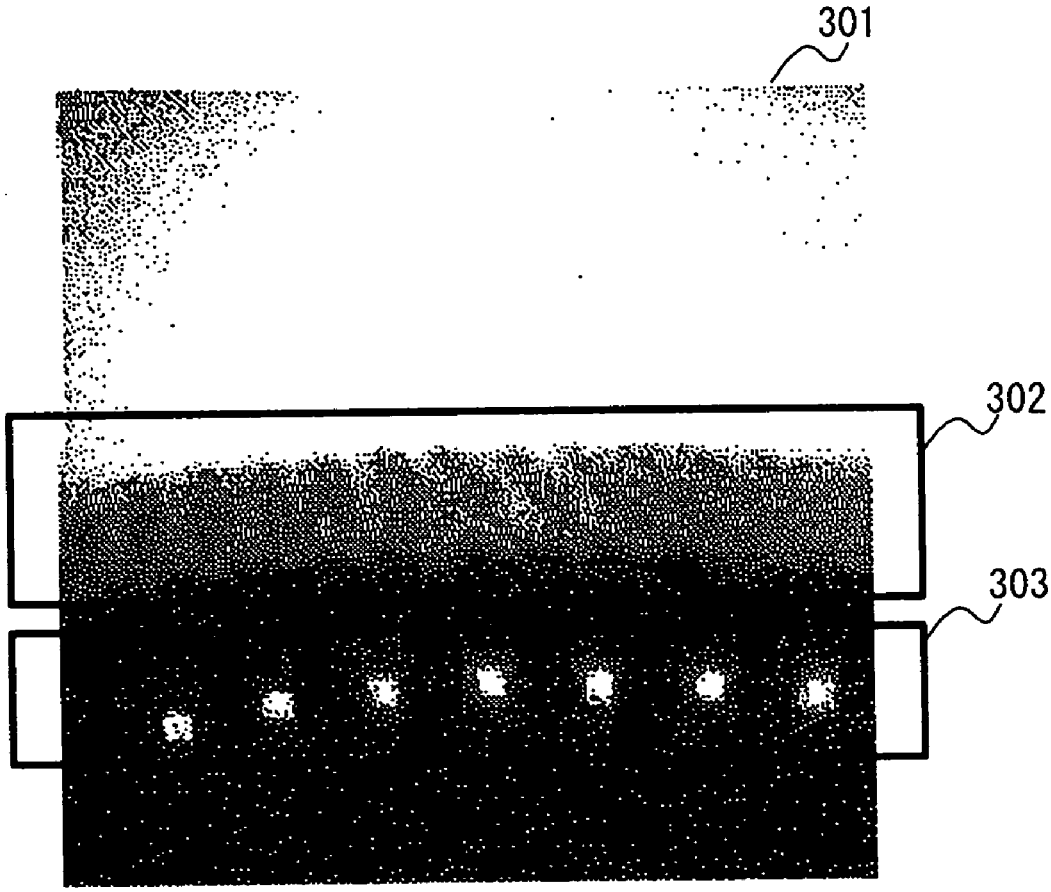
FIG. 5 is a diagram showing an image example of the coin photographed by the structure of FIG. 4.

FIG. 5 shows an image example of the coin photographed by the structure of FIG. 4.

As shown in FIG. 5, the coin outer periphery portion image pickup area 303 has an image with the edge of the projecting pattern 202 emphasized, so that the projecting pattern distinguishing unit 114 distinguishes the coin C by an image processing method suitable for image pickup with the edge emphasized (e.g., a method of detecting a distance between the outer periphery and the projecting pattern of the coin C, a method of detecting a distance between the projecting patterns, etc.).

In the above description, the embodiment having the coin C falling freely through the coin passage 101 was indicated, but it can also be configured to roll the coin C along the bottom surface of the inclined coin passage 101, and in such a case, a still image of the rolling coin C can be obtained by the image sensor 110 in the same way as described above by momentary lighting of the flash shooting first light source 104 and the flash shooting second light source 106.

INDUSTRIAL APPLICABILITY

According to the present invention, the image of the side of a coin and the image of the outer periphery portion of the surface of the coin can be concurrently taken by a simple structure, so that the device can be made compact, and the presence or not of mills and a projecting pattern impressed on the outer periphery portion are detected from the obtained images. Thus, the coin can be distinguished with a high accuracy.

The invention claimed is:

1. A coin distinguishing method, characterized by comprising:

irradiating a side of a subject coin with a first light source;

irradiating an outer periphery portion of a surface of the subject coin with a second light source in synchronism with the first light source;

simultaneously receiving reflection light from the side of the subject coin and reflection light from the outer periphery portion of the surface of the subject coin by an optical sensor to simultaneously obtain images of the side and the outer periphery portion of the surface of the subject coin in one image;

cutting off an image of the side of the subject coin and an image of the outer periphery portion of the surface of the subject coin from the obtained one image; and distinguishing a pattern formed on the side of the subject coin based on the cut-off image of the side of the subject coin and distinguishing a projecting pattern impressed on the outer periphery portion of the surface of the subject coin based on the cut-off image of the outer periphery portion of the surface of the subject coin.

2. The coin distinguishing method according to claim 1, characterized in the second light source irradiates light having a wave length region identical with that of the first light source.

3. The coin distinguishing method according to claim 2, characterized in that:

the second light source irradiates light having a wavelength region different from that of the first light source.

4. The coin distinguishing method according to claim 1, characterized in that:

the second light source is disposed to incline at a predetermined angel relative to the surface of the subject coin so to easily distinguish the projecting pattern impressed on the outer periphery portion of the surface of the subject coin.

5. The coin distinguishing method according to claim 1, characterized in that the opticial sensor is disposed to oppose to a boundary of the side of the subject coin and the outer periphery portion of the surface of the subject coin.

6. A coin distinguishing device, characterized by comprising:

a first light source for irradiating a side of a subject coin;

a second light source for irradiating an outer periphery portion of a surface of the subject coin in synchronism with the first light source;

an optical sensor for simultaneously obtaining images of the side and the outer periphery portion of the surface of the subject coin in one image by simultaneously receiving reflection light from the side of the subject coin and reflection light from the outer periphery portion of the surface of the subject coin;

first cut-off means for cutting off an image of the side of the subject coin from the one image obtained by the optical sensor;

second cut-off means for cutting off an image of the outer periphery portion of the surface of the subject coin from the one image obtained by the optical sensor;

first distinguishing means for distinguishing a pattern formed on the side of the subject coin based on the image cut-off by the first cut-off means; and second distinguishing means for distinguishing a projecting pattern impressed on the outer periphery portion of the surface of the subject coin based on the image cut-off by the second cut-off means.

7. The coin distinguishing device according to claim 6, characterized in that the second light source irradiates light having a wave length region identical with that of the first light source.

8. The coin distinguishing device according to claim 6, characterized in that the second light source irradiates light having a wavelength region different from that of the first light source.

9. The coin distinguishing device according to claim 6, characterized in that the second light source is disposed to incline at a predetermined angle relative to the surface of the subject coin so to easily distinguish the projecting pattern impressed on the outer periphery portion of the surface of the subject coin.

10. The coin distinguishing device according to claim 9, characterized in that the optical sensor is disposed to oppose to a boundary of the side of the subject coin and the outer periphery portion of the surface of the subject coin.

* * * * *